US010000705B2

(12) United States Patent
Faegh et al.

(10) Patent No.: US 10,000,705 B2
(45) Date of Patent: Jun. 19, 2018

(54) APPARATUS FOR PRODUCING HIGH VCM COKE

(71) Applicant: Catalytic Distillation Technologies, Pasadena, CA (US)

(72) Inventors: Ahmad Faegh, Missouri City, TX (US); John E. Collins, Houston, TX (US); Virendra Manral, Houston, TX (US); Gary Reisen, Houston, TX (US)

(73) Assignee: Catalytic Distillation Technologies, Pasadena, TX (US)

( * ) Notice: Subject to any disclaimer, the term of this patent is extended or adjusted under 35 U.S.C. 154(b) by 326 days.

(21) Appl. No.: 14/744,462

(22) Filed: Jun. 19, 2015

(65) Prior Publication Data

US 2015/0284640 A1 Oct. 8, 2015

Related U.S. Application Data

(62) Division of application No. 13/469,593, filed on May 11, 2012, now Pat. No. 9,062,256.

(Continued)

(51) Int. Cl.

| | |
|---|---|
| ***C01G 9/00*** | (2006.01) |
| ***C10B 41/08*** | (2006.01) |
| ***C10B 27/06*** | (2006.01) |
| ***C10G 9/00*** | (2006.01) |
| ***C10B 41/00*** | (2006.01) |
| ***C10B 55/00*** | (2006.01) |

(Continued)

(52) U.S. Cl.

CPC ..... *C10G 9/005* (2013.01); *C10B 27/06* (2013.01); *C10B 39/06* (2013.01); *C10B 41/00* (2013.01);

(Continued)

(58) Field of Classification Search

CPC ..... C10G 9/005; C10B 27/06; C10B 41/08

See application file for complete search history.

(56) References Cited

U.S. PATENT DOCUMENTS

| | | | |
|---|---|---|---|
| 2,963,416 | A | 12/1960 | Ward et al. |
| 3,617,514 | A | 11/1971 | Marlar |

(Continued)

FOREIGN PATENT DOCUMENTS

| | | | |
|---|---|---|---|
| EP | 0200786 | A1 | 11/1986 |
| EP | 2330175 | A2 | 6/2011 |
| WO | 03018715 | A1 | 3/2003 |

OTHER PUBLICATIONS

Communication pursuant to Article 94(3) EPC dated Nov. 16, 2016 in corresponding European application No. 12785953.6 (6 pages).

(Continued)

*Primary Examiner* — Renee Robinson

(74) *Attorney, Agent, or Firm* — Osha Liang LLP

(57) ABSTRACT

A process and apparatus for improving the production of coke having a high volatile combustible material content are disclosed. The process may include, for example: heating a coker feedstock to a coking temperature to produce a heated coker feedstock; contacting the heated coker feedstock with a quench medium to reduce a temperature of the heated coker feedstock and produce a quenched feedstock; feeding the quenched feedstock to a coking drum; subjecting the quenched feedstock to thermal cracking in the coking drum to (a) crack a portion of the quenched feedstock to produce a cracked vapor product, and (b) produce a coke product having a volatile combustible material (VCM) concentration in the range from about 13% to about 50% by weight, as measured by ASTM D3175.

13 Claims, 1 Drawing Sheet

Related U.S. Application Data

(60) Provisional application No. 61/485,969, filed on May 13, 2011.

(51) Int. Cl.
*C10B 57/04* (2006.01)
*C10B 39/06* (2006.01)
*C10L 5/04* (2006.01)

(52) U.S. Cl.
CPC ..... *C10B 41/08* (2013.01); *C10B 55/00* (2013.01); *C10B 57/045* (2013.01); *C10L 5/04* (2013.01); *C10G 2300/107* (2013.01); *C10G 2300/1077* (2013.01); *C10G 2300/4006* (2013.01); *C10G 2300/4081* (2013.01); *C10G 2400/06* (2013.01); *C10L 2290/02* (2013.01); *C10L 2290/06* (2013.01); *C10L 2290/58* (2013.01)

(56) References Cited

U.S. PATENT DOCUMENTS 3,923,921 A 12/1975 Kohfeldt
4,279,734 A 7/1981 Gwyn
4,666,585 A * 5/1987 Figgins ..... C10B 55/00 208/13
6,168,709 B1 1/2001 Etter
7,371,317 B2 * 5/2008 Newman ..... C10B 55/00 208/131
2006/0032788 A1 2/2006 Etter

OTHER PUBLICATIONS

Substantive Examination Report issued in corresponding Indonesian application No. WO0201305435 (w/translation) (2 pages).
Official Action dated Apr. 11, 2016 in corresponding Eurasian application No. 201391691 (w/translation) (6 pages).
Correspondence reporting a Third Office Action dated Sep. 17, 2015 in corresponding Chinese Application No. 201280023755.X (10 pages).
Substantive Examination Adverse Report dated Feb. 29, 2016 in corresponding Malaysian application No. PI2013004089 (4 pages).
Official Action dated Oct. 22, 2015 in corresponding Eurasian application No. 201391691 (w/translation) (4 pages).
Correspondence reporting an Official Action dated Jun. 8, 2016 in corresponding Mexican Application No. MX/a/2013/013040 (6 pages).

* cited by examiner

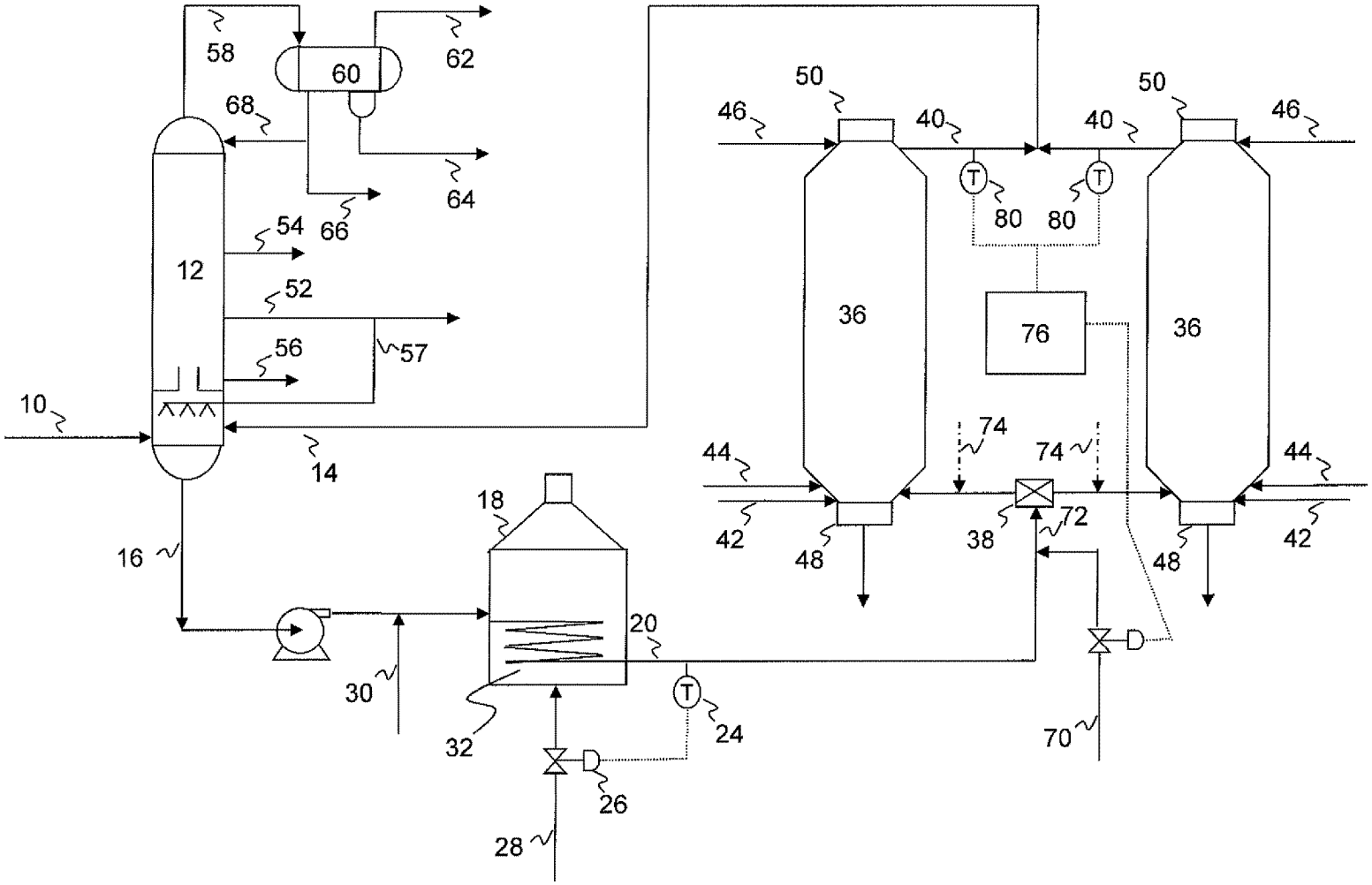
10
12
14
16
18
20
24
26
28
30
32
36
38
40
42
44
46
48
50
52
54
56
57
58
60
62
64
66
68
70
72
74
76
80

APPARATUS FOR PRODUCING HIGH VCM COKE

CROSS-REFERENCE TO RELATED APPLICATION

This application, pursuant to 35 U.S.C. § 120, claims benefit to U.S. patent application Ser. No. 13/469,593 filed May 11, 2012, now U.S. Pat. No. 9,062,256, which pursuant to 35 U.S.C. § 119(e), claims priority to U.S. Provisional Application Ser. No. 61/485,969, filed May 13, 2011. Each of these applications is incorporated herein by reference in their entirety. That application is herein incorporated by reference in its entirety.

FIELD OF THE DISCLOSURE

Embodiments disclosed herein relate generally to the field of petroleum coking processes and apparatus. More specifically, embodiments disclosed herein relate to the production of coke having a high concentration of volatile combustible material (high VCM coke).

BACKGROUND

The delayed coking process has evolved with many improvements since the mid-1930s. Essentially, delayed coking is a semi-continuous process in which the heavy feedstock is heated to a high temperature (between 900° F. and 1000° F.) and transferred to large coking drums. Sufficient residence time is provided in the coking drums to allow the thermal cracking and coking reactions to proceed to completion. The heavy residua feed is thermally cracked in the drum to produce lighter hydrocarbons and solid, petroleum coke. One of the initial patents for this technology (U.S. Pat. No. 1,831,719) discloses "The hot vapor mixture from the vapor phase cracking operation is, with advantage, introduced into the coking receptacle before its temperature falls below 950° F., or better 1050° F., and usually it is, with advantage, introduced into the coking receptacle at the maximum possible temperature." The "maximum possible temperature" in the coke drum favors the cracking of the heavy residua, but is limited by the initiation of coking in the heater and downstream feed lines, as well as excessive cracking of hydrocarbon vapors to gases (butane and lighter). When other operational variables are held constant, the "maximum possible temperature" normally minimizes the volatile material remaining in the petroleum coke by-product. In delayed coking, the lower limit of volatile material in the petroleum coke is usually determined by the coke hardness. That is, petroleum coke with <8 wt. % volatile materials is normally so hard that the drilling time in the decoking cycle is extended beyond reason. Various petroleum coke uses have specifications that require the volatile content of the petroleum coke by-product be <12%. Consequently, the volatile material in the petroleum coke by-product typically has a target range of 8-12 wt. %.

U.S. Pat. No. 6,168,709 discloses a process for producing a petroleum coke having a higher concentration of volatile combustible material (VCM). The higher VCM content is provided such that the coke may sustain self-combustion, among other characteristics for use of the coke as a fuel. To result in the high VCM coke, the '709 patent teaches that the coker feedstock is initially heated to a lower temperature, thereby resulting in an associated decrease in coking drum operating temperatures.

SUMMARY OF THE DISCLOSURE

Yield of coke, yield of cracked hydrocarbon products, or both, may be negatively affected by decreasing the heater outlet temperature. Further, reduction in the heater outlet temperature may also affect coker throughput and efficiency. It has been found that operating the feed heater at typical operating temperatures may provide for cracking of the coker feed in the transfer line between the heater and the coking drum, and quenching of the heated coker feedstock to reduce the coking temperature may provide for operation of the coking drum to produce a high VCM coke having desirable properties (combustion properties, a high proportion of sponge coke crystalline structure to other crystalline structures, etc.).

In one aspect, embodiments disclosed herein relate to a process for producing a coke fuel, the process comprising: heating a coker feedstock to a coking temperature to produce a heated coker feedstock; contacting the heated coker feedstock with a quench medium to reduce a temperature of the heated coker feedstock and produce a quenched feedstock; feeding the quenched feedstock to a coking drum; subjecting the quenched feedstock to thermal cracking in the coking drum to (a) crack a portion of the quenched feedstock to produce a cracked vapor product, and (b) produce a coke product having a volatile combustible material (VCM) concentration in the range from about 13% to about 50% by weight, as measured by ASTM D3175.

In another aspect, embodiments disclosed herein relate to an apparatus for producing a coke fuel, the apparatus comprising: a heater for heating a coker feedstock to a coking temperature to produce a heated coker feedstock; a fluid conduit for recovering the heated coker feedstock from the heater; a fluid conduit for supplying a quench medium; a device for contacting the heated coker feedstock with the quench medium to reduce a temperature of the heated coker feedstock and produce a quenched effluent; a fluid conduit for feeding the quenched effluent to a coking drum for thermal cracking of the quenched effluent to (a) crack a portion of the quenched effluent to produce a cracked vapor product, and (b) produce a coke product having a volatile combustible material (VCM) concentration in the range from about 13% to about 50% by weight, as measured by ASTM D3175.

Other aspects and advantages will be apparent from the following description and the appended claims.

BRIEF DESCRIPTION OF DRAWINGS

FIG. 1 is a simplified process flow diagram of a coking process according to embodiments disclosed herein.

DETAILED DESCRIPTION

In one aspect, embodiments disclosed herein relate to the production of coke having a high concentration of volatile combustible material (high VCM coke). In another aspect, embodiments disclosed herein relate to improving the operation of coke processes to provide for one or more of increased throughput, sufficient coke make, and desirable coke properties, including coke crystalline structure, softness, combustion properties, and a VCM content of greater than 13% or 15% by weight, such as around 18% to 20%.

To produce coke having a high VCM content, as noted above, the prior art indicated that it was necessary to operate the coking drums at a relatively low temperature. To achieve the low operating temperatures in the coking drum, it was taught to decrease the temperature of the feedstock at the outlet of the coker heater.

Cracking that may occur in the transfer line between the coker heater and the coking drums allows for production of desirable lighter hydrocarbons. As such it is desirable to run the heater at relatively high temperatures. However, production of coke with a high VCM content requires operating the coking drums at a lower temperature. To meet the objectives of cracking and high VCM coke make, it has been found that quenching the feed to the coking drums via direct heat exchange with a quench medium may provide for both high heater outlet temperatures and low coking drum operating temperatures.

Referring now to FIG. 1, a coking process according to embodiments disclosed herein is illustrated. A coker feedstock 10 is introduced into the bottom portion of a coker fractionator 12, where it combines with hydrocarbons condensed from coker vapor stream 14. The resulting mixture 16 is then pumped through a coker heater 18, where it is heated to the desired coking temperature, such as between 850° F. and 1100° F., causing partial vaporization and mild cracking of the coker feedstock. The temperature of the heated coker feedstock 20 may be measured and controlled by use of a temperature sensor 24 that sends a signal to a control valve 26 to regulate the amount of fuel 28 fed to the heater 18. If desired, steam or boiler feedwater 30 may be injected into the heater to reduce coke formation in the tubes 32.

The heated coker feedstock 20 may be recovered from the coker heater 18 as a vapor-liquid mixture for feed to coking drums 36. Two or more drums 36 may be used in parallel, as known in the art, to provide for continued operation during the operating cycle (coke production, coke recovery (decoking), preparation for next coke production cycle, repeat). A control valve 38 diverts the heated feed to the desired coking drum 36. Sufficient residence time is provided in the coking drum 36 to allow the thermal cracking and coking reactions to proceed to completion. In this manner, the vapor-liquid mixture is thermally cracked in the coking drum 36 to produce lighter hydrocarbons, which vaporize and exit the coke drum via flow line 40. Petroleum coke and some residuals (e.g. cracked hydrocarbons) remain in the coking drum 36. When the coking drum 36 is sufficiently full of coke, the coking cycle ends. The heated coker feedstock 20 is then switched from the first coking drum 36 to a parallel coking drum to initiate its coking cycle. Meanwhile, the decoking cycle begins in the first coking drum.

In the decoking cycle, the contents of the coking drum are cooled down, remaining volatile hydrocarbons are removed, the coke is drilled from the coking drum, and the coking drum is prepared for the next coking cycle. Cooling the coke normally occurs in three distinct stages. In the first stage, the coke is cooled and stripped by steam or other stripping media 42 to economically maximize the removal of recoverable hydrocarbons entrained or otherwise remaining in the coke. In the second stage of cooling, water or other cooling media 44 is injected to reduce the coking drum temperature while avoiding thermal shock to the coking drum. Vaporized water from this cooling media further promotes the removal of additional vaporizable hydrocarbons. In the final cooling stage, the coking drum is quenched by water or other quenching media 46 to rapidly lower the coking drum temperatures to conditions favorable for safe coke removal. After the quenching is complete, the bottom and top heads 48, 50 of the coking drum 36 are removed. The petroleum coke 36 is then cut, typically by hydraulic water jet, and removed from the coking drum. After coke removal, the coking drum heads 48, 50 are replaced, the coking drum 36 is preheated, and otherwise readied for the next coking cycle.

The lighter hydrocarbon vapors recovered as an overheads fraction 40 from coking drum 36 are then transferred to the coker fractionator 12 as coker vapor stream 14, where they are separated into two or more hydrocarbon fractions and recovered. For example, a heavy coker gas oil (HCGO) fraction 52 and a light coker gas oil (LCGO) fraction 54 may be drawn off the fractionator at the desired boiling temperature ranges. HCGO may include, for example, hydrocarbons boiling in the range from 650-870° F. LCGO may include, for example, hydrocarbons boiling in the range from 400-650° F. In some embodiments, other hydrocarbon fractions may also be recovered from coker fractionator 12, such as a quench oil fraction 56, which may include hydrocarbons heavier than HCGO, and/or a wash oil fraction 57. The fractionator overhead stream, coker wet gas fraction 58, goes to a separator 60, where it is separated into a dry gas fraction 62, a water/aqueous fraction 64, and a naphtha fraction 66. A portion of naphtha fraction 66 may be returned to the fractionator as a reflux 68.

The temperature of the materials within the coking drum 36 throughout the coke formation stage may be used to control the type of coke crystalline structure and the amount of volatile combustible material in the coke. The temperature of the vapors leaving the coke drum via flow line 40 is thus an important control parameter used to represent the temperature of the materials within the coking drum 36 during the coking process.

To attain the dual objective of significant cracking and high VCM coke formation, it is desirable to operate the coker heater 18 at an outlet temperature greater than that of the coking drum 36. While some heat loss naturally occurs during transfer of the heated coker feedstock from the heater to the coking drum, due to cracking (endothermic), environmental losses, etc., without additional measures the coking drum would operate at a temperature too high for production of the desired high VCM coke product. Accordingly, the coker feedstock recovered from coker heater 18 is fed most of the way to the coking drum with only normal temperature losses, such as due to cracking and environmental losses. The heated coker feedstock is then contacted with a quench medium 70 upstream of the coking drum 36 to reduce the temperature of the coker feed. The quenched feedstock 72 may then be fed to the coking drum for continued cracking and production of coke at a temperature sufficient to produce a coke product having a VCM content in the range from about 13% to about 50% by weight, as measured by ASTM D3175. In other embodiments, the coke product having a VCM content in the range from about 15% to about 25% by weight; and from about 16% to about 22% by weight in yet other embodiments.

The quench medium is preferably contacted with the heated coker feedstock as close to the coking drum as reasonably possible, providing for a longer residence time at the higher heater outlet temperature. For example, as illustrated, the quench medium 70 may be introduced immediately upstream of the diverter valve 38. Alternatively, the quench medium 70 may be introduced via flow line 74, downstream of the diverter valve 38, such as in the transfer line between the valve 38 and the coking drum 36.

The temperature of the coking drum overhead vapor fraction 40, measured by temperature probes 80, for example, may be used to monitor and control the coking process and the coke product quality (VCM content, crystalline structure, etc.). In some embodiments, the temperature of the vapor product recovered from the coking drum may be controlled, for example, by using a digital control system (DCS) or other process control systems 76, to be within the range from about 700° F. to about 900° F.; in the range from about 725° F. to about 875° F. in other embodiments; in the range from about 750° F. to about 850° F. in other embodiments; and in the range from about 775° F. to about 800° F. in yet other embodiments. The temperature of the vapor outlet 40 may be controlled, for example, by adjusting the flow rate of the quench medium 70, as illustrated, by adjusting a temperature of the quench medium (not illustrated), or combinations thereof, among other alternatives that may be readily envisioned by one skilled in the art.

In some embodiments, the coker heater outlet temperature may be in the range from about 900° F. to about 1100° F. The quench step may result in a decrease in the heated coker feedstock temperature of at least 10, 20, 30, 40, 50, 100, 150, or 200 degrees or more, thereby achieving the desired coking drum vapor outlet temperature. The differential operating temperature, i.e., coker heater outlet temperature minus the coking drum outlet vapor temperature, may be in the range from about 25° F. to about 350° F. in some embodiments, and in the range from about 50° F. to about 200° F. in other embodiments.

Coker feedstocks may include any number of refinery process streams which cannot economically be further distilled, catalytically cracked, or otherwise processed to make fuel-grade blend streams. Typically, these materials are not suitable for catalytic operations because of catalyst fouling and/or deactivation by ash and metals. Common coker feedstocks include atmospheric distillation residuum, vacuum distillation residuum, catalytic cracker residual oils, hydrocracker residual oils, and residual oils from other refinery units.

The quench medium used may include at least a portion of one or more of the following: the recycle fraction 56, the HCGO fraction 52, the LCGO fraction 54, and the naphtha fraction 66; a recycle fraction generated as a result of wash oil in the wash zone of the coker fractionator; and the coker feedstock 10. Additionally or alternatively, the quench medium may include one or more of the following: crude oil, atmospheric column bottoms, vacuum tower bottoms, slurry oil, a liquid product stream from the crude or vacuum units, and in general, hydrocarbons mixtures including hydrocarbons having a boiling point in the range from about 500° F. to about 950° F.

As known in the art, the coker feedstock may be treated upstream of the coker fractionator 12. For example, the coker feedstock may undergo a hydrotreating process, a desalting process, a demetallization process, a desulfurization process, or other pretreatments processes useful to produce a desirable coke product.

Various chemical and/or biological agents may be added to the coking process to inhibit the formation of shot coke and/or promote the formation of desirable sponge coke. In particular embodiments, an anti-foaming agent may be added, such as a silicon-based additive. The chemical and/or biological agents may be added at any point in the process, and in some embodiments are added along with the quench medium 70.

As described above, embodiments described herein advantageously provide for both cracking and production of high VCM coke. By use of a quench medium to control temperature in the coking drums, as opposed to heater outlet temperature, one or more of coker throughput, liquid hydrocarbon yield, coke make, sponge coke content may be positively affected.

While the disclosure includes a limited number of embodiments, those skilled in the art, having benefit of this disclosure, will appreciate that other embodiments may be devised which do not depart from the scope of the present disclosure. Accordingly, the scope should be limited only by the attached claims.

What is claimed is:

1. An apparatus for producing a coke fuel, the apparatus comprising:

a heater for heating a coker feedstock to a coking temperature to produce a heated coker feedstock having a temperature in the range from about 900° F. to about 1100° F.;

a fluid conduit for recovering the heated coker feedstock from the heater;

a fluid conduit for supplying a quench medium;

a device, disposed proximate an inlet of a coking drum, for contacting the heated coker feedstock with the quench medium to reduce a temperature of the heated coker feedstock and produce a quenched effluent;

a means for measuring a temperature of the recovered cracked vapor product proximate the coking drum;

a process control system configured to decrease a temperature of the heated coker feedstock by at least 100° F. (heated coker feedstock temperature minus quenched effluent temperature) by adjusting at least one of a feed rate and a temperature of the quench medium;

a fluid conduit for feeding the quenched effluent to the coking drum for thermal cracking of the quenched effluent to (a) crack a portion of the quenched effluent to produce a cracked vapor product, and (b) produce a coke product having a volatile combustible material (VCM) concentration in the range from about 13% to about 50% by weight, as measured by ASTM D3175.

2. The apparatus of claim 1, further comprising a fluid conduit for recovering the cracked vapor product from the coking drum.

3. The apparatus of claim 1, further comprising a coker fractionator for fractionating the recovered cracked vapor product into two or more fractions including at least one of a quench oil fraction, a wash oil fraction, a coker heavy gas oil fraction, a coker light gas oil fraction, and a naphtha fraction.

4. An apparatus for producing a coke fuel, the apparatus comprising:

a heater for heating a coker feedstock to a coking temperature to produce a heated coker feedstock;

a fluid conduit for recovering the heated coker feedstock from the heater, and for transferring the heated coker feedstock while cracking the heated coker feedstock;

a diverter valve for directing a flow of the heated coker feedstock to a first coking drum and away from a second coking drum;

a fluid conduit for supplying a quench medium;

a device, disposed immediately upstream of the diverter valve, for contacting the heated coker feedstock with the quench medium to reduce a temperature of the heated coker feedstock and produce a quenched effluent;

a fluid conduit for feeding the quenched effluent from the diverter valve to the first coking drum for thermal cracking of the quenched effluent to (a) crack a portion of the quenched effluent to produce a cracked vapor product, and (b) produce a coke product having a volatile combustible material (VCM) concentration in the range from about 13% to about 50% by weight, as measured by ASTM D3175;

a means for measuring a temperature of the recovered cracked vapor product proximate the coking drum; and a process control system configured to:

regulate an amount of fuel fed to the heater to operate the heater at a heated coker feedstock outlet temperature in the range of 900° F. to 1100° F.;

adjust at least one of a quench medium feed rate and a quench medium temperature to decrease a temperature of the heated coker feedstock by at least 100° F. (heated coker feedstock temperature minus quenched effluent temperature);

control a temperature of the cracked vapor product recovered from a coker vapor outlet at a temperature in the range from about 700° F. to about 900° F.

5. The apparatus of claim 4, wherein the diverter valve and the device for contacting are located proximate the coking drum.

6. The apparatus of claim 4, further comprising a coker fractionator for fractionating the recovered cracked vapor product into two or more fractions including at least one of a quench oil fraction, a wash oil fraction, a coker heavy gas oil fraction, a coker light gas oil fraction, and a naphtha fraction.

7. The apparatus of claim 4, wherein the process control system is configured to decrease a temperature of the heated coker feedstock by at least 200° F.

8. An apparatus for producing a coke fuel, the apparatus comprising:

a heater for heating a coker feedstock to a coking temperature to produce a heated coker feedstock having a temperature in the range from about 900° F. to about 1100° F.;

a first fluid conduit for recovering the heated coker feedstock from the heater and for providing a residence time for cracking of the heated coker feedstock during transport of the heated coker feedstock to a diverter valve for directing a flow of the heated coker feedstock to one of a first coking drum and a second coking drum;

a second fluid conduit for supplying a quench medium;

a heat exchanger for indirectly heating and/or cooling the quench medium;

a first device, disposed intermediate the diverter valve and an inlet of the first coking drum, for contacting the heated coker feedstock with the quench medium to reduce a temperature of the heated coker feedstock and produce a quenched effluent;

a third fluid conduit for feeding the quenched effluent to the first coking drum for thermal cracking of the quenched effluent to (a) crack a portion of the quenched effluent to produce a cracked vapor product, and (b) produce a coke product having a volatile combustible material (VCM) concentration in the range from about 13% to about 50% by weight, as measured by ASTM D3175;

a means for measuring a temperature of the recovered cracked vapor product proximate the coking drum; and a process control system configured to:

operate the heater at a temperature of at least 900° F. so as to promote cracking of the heated coker feedstock during transfer in the first fluid conduit;

decrease a temperature of the heated coker feedstock by at least 100° F. (heated coker feedstock temperature minus quenched effluent temperature) by adjusting at least one of a feed rate and a temperature of the quench medium;

control a temperature in the coking drums via the quench medium to produce the coke product having a volatile combustible material (VCM) concentration in the range from about 13% to about 50% by weight.

9. The apparatus of claim 8, wherein the first device for contacting is located proximate the first coking drum.

10. The apparatus of claim 8, further comprising:

a second device, disposed intermediate the diverter valve and an inlet of the second coking drum, for contacting the heated coker feedstock with the quench medium to reduce a temperature of the heated coker feedstock and produce a quenched effluent;

a fluid conduit for feeding the quenched effluent to the second coking drum for thermal cracking of the quenched effluent to (a) crack a portion of the quenched effluent to produce a cracked vapor product, and (b) produce a coke product having a volatile combustible material (VCM) concentration in the range from about 13% to about 50% by weight, as measured by ASTM D3175.

11. The apparatus of claim 10, wherein the second device for contacting is located proximate the second coking drum.

12. The apparatus of claim 8, further comprising a fluid conduit for recovering the cracked vapor product from the first coking drum.

13. The apparatus of claim 8, further comprising a coker fractionator for fractionating the recovered cracked vapor product into two or more fractions including at least one of a quench oil fraction, a wash oil fraction, a coker heavy gas oil fraction, a coker light gas oil fraction, and a naphtha fraction.

* * * * *